United States Patent [19]

Johnson

[11] Patent Number: 4,842,609

[45] Date of Patent: Jun. 27, 1989

[54] FLAME RETARDANT TREATMENTS FOR POLYESTER/COTTON FABRICS

[75] Inventor: James R. Johnson, McLeansville, N.C.

[73] Assignee: Burlington Industries, Inc., Greensboro, N.C.

[21] Appl. No.: 216,185

[22] Filed: Jul. 7, 1988

Related U.S. Application Data

[63] Continuation-in-part of Ser. No. 870,892, Jun. 5, 1986, abandoned.

[51] Int. Cl.[4] ..... D06M 9/00; D06P 5/00

[52] U.S. Cl. ..... 8/115.7; 8/115.56; 8/115.57; 8/115.61; 8/115.64; 8/127.1; 8/490; 8/532

[58] Field of Search ..... 8/115.7, 127.1, 115.61, 8/115.64

[56] References Cited

U.S. PATENT DOCUMENTS

T900021 7/1972 Caldwell et al. ..... 117/136

3,877,974 4/1975 Mischutin ..... 252/8.1

4,066,812 1/1978 Kaupin ..... 8/115.61

4,311,855 1/1982 Cole et al. ..... 564/12

4,494,951 1/1985 Cole et al. ..... 8/193

4,623,583 11/1986 Mischutin ..... 428/242

FOREIGN PATENT DOCUMENTS 874382 6/1971 Canada .

OTHER PUBLICATIONS

A. R. Smith in "Chemical Aftertreatment of Textiles", (Wiley-Interscience), 1971, pp. 591-592.

*Primary Examiner*—A. Lionel Clingman

*Attorney, Agent, or Firm*—Nixon & Vanderhye

[57] ABSTRACT

Polyester/cotton fabrics are flame retardant treated with a flame-retardant cyclic phosphonate ester and tetrakis-(hydroxymethyl)phosphonium sulfate (THPS), usually applied simultaneously, then cured. The resulting fabrics retain their flame-retardant properties after numerous machine washings and have an acceptable hand.

23 Claims, No Drawings

FLAME RETARDANT TREATMENTS FOR POLYESTER/COTTON FABRICS

CROSS-REFERENCE TO RELATED APPLICATIONS

This application is a continuation-in-part of application Ser. No. 870,892 filed June 5, 1986 aband.

This invention relates to a process for imparting flame-retardant properties to polyester/cotton blended fabrics. In its preferred form, it uses two flame-retardant chemicals or flame-retardant systems, one specific to the polyester component and the other specific to the cotton component.

BACKGROUND OF THE INVENTION

Prior attempts to achieve acceptable flame-retarded polyester/cotton blends have not met with commercial success. None of the treatments is practical from the consumer point of view, producing fabrics that have a very stiff hand. This is because in order to achieve the requisite flame-retardant properties, a high chemical add-on is required. This add-on makes the fabric stiff, masks the color of the underlying fabric, and often imparts an acrid or unacceptable odor to the fabric. In addition, the performance of the flame-retardant treated fabrics is often unreliable.

Most of the previous work conducted on flame-retardant (hereinafter sometimes "FR") polyester/cotton blends used a single chemical system that was targeted for the cotton component of the blend. The approach was to "load" the fabrics with a flame-retardant specific for cotton, for instance THPS [tetrakis-(hydroxymethyl)phosphonium sulfate]. It was not unusual with these earlier products to use from 30 to 35% of fixed chemical add-on in order for the polyester/cotton blend fabric to pass a bottom vertical flame test. Regrettably, however, the aesthetics of the finished fabrics were poor, as they had a very stiff hand and the appearance of a coated fabric. The add-ons used for these products were far in excess of the theoretically required amounts.

When THPS is applied to a polyester/cotton blend, about 3% of fixed phosphorus is required to achieve flame-retardant results. Since the THPS is specific to cotton, it does not react with the polyester content of the fabric but simply physically coats the polyester. As a result, after multiple launderings, that portion of the flame-retardant surrounding the polyester fiber is partially lost. In consequence, it was not unusual to use as much as 5.5% phosphorus add-on for a polyester/cotton blend, at least initially, in order to result in the target 3% of fixed phosphorus after 50 launderings in hot water.

In the 1970's, polyester/cotton blends were flame retardant treated using tris-2,3-dibromopropyl phosphate ("tris") in combination with THPS. However, "Tris" was found to be a carcinogen and was withdrawn from the market, so that there is no predominantly-polyester blend of polyester and cotton sold today that has been treated with flame-retardant chemicals. An object of the present invention is to produce acceptable flame-retardant treated polyester/cotton blends using multiple flame-retardant chemicals or chemical systems, and to employ processing conditions or adjuvants that produce a commercially acceptable attractive product having good color and acceptable hand.

BRIEF DESCRIPTION OF THE INVENTION

The process of the present invention employs two flame-retardant (FR) systems, one specific to the polyester component and the other specific to the cotton component of the polyester/cotton blends being flame-retarded. With this approach, the amount of fire retardant, such as THPS, required to satisfy flame-retardant standards can be reduced significantly, and the resulting fabrics have not only better fire retardant characteristics, but also better aesthetics. In the processes disclosed in more detail below, different FR chemicals are applied in a combined fashion in a single bath or applied separately in separate baths. In addition, application in multiple steps (as described in V, below) can be used to achieve more efficient and more economical use of the rather costly FR chemicals. Processing conditions, especially temperatures and humidities, are carefully controlled in order to optimize the use of the FR chemicals and to ensure good fixation to the polyester/cotton blends, even after several launderings.

The polyester/cotton blends treated in accordance with the present invention contain between 35% and 80% of polyester, the balance being cotton.

The term "polyester" is used in its usual sense to mean highly polymeric, essentially linear polyester resins made by the reaction of a dicarboxylic acid or ester with a diol in the presence of an esterification or ester interchange catalyst. Illustrative dicarboxylic acids are malonic, succinic, adipic, azelaic, maleic, fumaric, hydromuconic, isophthalic, terephthalic, and cyclohexane-dicarboxylic acids. Representative diols are ethylene glycol, propylene glycol, butylene glycol and 1,6-hexanediol. See U.S. Pat. Nos. 2,465,319 and 2,901,446. The common commercial polyester resins are polyethylene terephthalate and polyethylene terephthalate modified by inclusion of minor proportions of a different glycol or dicarboxylic acid during the polyesterification process. The polyester used in the working examples that follow was polyethylene terephthalate.

The polyester/cotton fibrous materials which can be provided with a flame-retardant finish according to the invention can be in any desired stage of processing, i.e., they can be treated as woven or knitted fabrics, dyed or undyed, or as textiles which have already been further processed.

DETAILED DESCRIPTION OF THE INVENTION

The invention disclosed herein has several aspects which, for convenience, may be summarized according to the following scheme:

I. Application of a mixture of flame retardants, one member of the mixture specific for cotton and the other for polyester, after the fabric is dyed. According to the inventive process, the same bath is used to apply a mixture of two (or more) flame-retardant chemicals, one FR specific for the polyester component of the blend, and the other specific for the cotton component of the blend. As used herein, the preferred polyester flame retardant (FR) is Antiblaze 19, a cyclic phosphonate available from Albright & Wilson, Inc., of Richmond, Va. THPS, specific to the cotton component of the blend, is compatible with AB-19, and thus may be applied together in a single FR treatment bath, such as by padding onto the fabric with a fixed add-on typically in the range of 20–25% by weight. This combination pad bath is not recommended for fabrics dyed with direct dyes or reactive dyes as they tend to change color. However, vat dyes, naphthols, acid dyes and cationic dyes are fully acceptable. The hand of fabrics so treated is acceptable, and is substantially superior to the hand of any flame-retardant treated polyester/cotton fabrics heretofore known to the art. However, the hand can be further improved by the use of a softener such as Ucarsil SFT, a poly-functional epoxide of a siloxane sold by Union Carbide Corporation. It has been found that a silicone softener of this type not only improves the hand of the fabric, but also assists in fixing the FR material to the fibers.

The hand of the treated fabrics can be still further improved by conducting the curing operation in a moist, high-humidity environment. This procedure not only imparts an improved hand to the treated fabric, but it also causes better fixation of the FR chemicals so that the desirable FR properties are retained even after multiple launderings.

II. Use of hexabromocyclododecane applied as a dispersion. Hexabromocyclododecane is available from white chemical as Caliban FR P86, as CD-75 from Great Lakes Chemical and as Saytex HBCD from the Ethyl Corporation. It is sold primarily for use as a flame-retardant for plastics, in part because of its poor solubility in solvents commonly used for textile processing. Thus, it has found little use in the textile industry. Hexabromocyclododecane melts at about 360° F. When applied to a polyester/cotton fabric at elevated temperatures above its melting point, and then cooled, hexabromocyclododecane fuses to the fiber, imparting the requisite flame-retardant properties to the fibers of the polyester.

III. Multiple-step applications. As described above, it is possible to apply flame-retardant chemicals specific to polyester and specific to cotton in a single step. Normally, flame-retardant chemicals are applied in a one-step process, typically by a pad bath, but at fairly high concentrations. That is, about half of the pad bath is represented by a mixture of the two fire retardants, the balance being diluents, water and other pad bath adjuvants. In a two-step process, it is possible to reduce the concentration of FR chemicals in each pad bath.

In such a two-step process, the fabric is padded with a first pad bath containing about 70% of the normal fire retardant ingredients followed by heating to cure or fix the fire retardants on the fabric, then scouring to remove any excess FR chemicals and finally drying. The dried fabric is then subjected to the same process again, using the remaining 30% of the active FR chemicals. However, the second pad bath may additionally contain a reactive silicone compound to soften the fabric and to improve its hand. This multiple-step procedure is especially suitable for polyester/cotton blends in which cotton is present in a major amount, i.e., polyester in the range of 35–40% and cotton in the range of 60–65%.

The invention will now be illustrated with reference to the following examples in which all parts and percentages are by weight and temperatures reported in degrees Fahrenheit, unless otherwise indicated. The materials used are more fully described as follows:

Among the flame-retardant materials used in accordance with the present invention are thermally stable cyclic phosphonate esters prepared by reacting alkyl-halogen-free esters with a bicyclic phosphite. As a class, these cyclic phosphonate esters are represented by one of the formulas:

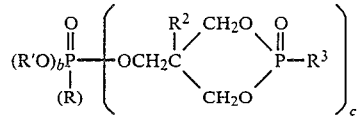

(A)

where a is 0 or 1; b is 0, 1 or 2, c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

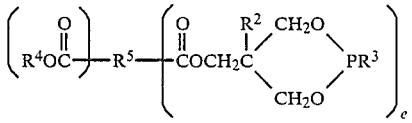

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenenyl.

The preferred compounds (see below) are represented by the formula:

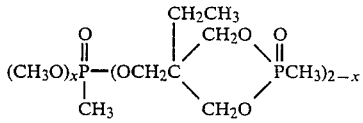

in which X is 0 or 1, and usually a 50:50 mixture of the mono- and di-esters. The preparation of these cyclic phosphonate esters and their use as flame retardants are described in U.S. Pat. No. 3,789,091 and 3,849,368, the disclosures of which are hereby incorporated by reference.

Antiblaze 19T, as described by the supplier Albright & Wilson Inc. of Richmond, Va., is a cyclic phosphonate ester, available as an odorless viscous liquid (viscosity 1000 cps at 100° F.) with a flashpoint of 340° F. (ASTM D-93).

Hexabromocyclododecane, as described by its supplier, Great Lakes Chemical Corporation of West Lafayette, Ind., is a cyclic alkyl bromide, empirical formula $C_{12}H_{18}Br_6$, CAS registry number 25637-99-4, composed of hexabromocyclododecane and related bromocycloalkanes. It is an odorless, water-insoluble, off-white powder having a melting point range of 288°–360° F.

Tetrakis-(hydroxymethyl)phosphonium sulfate (THPS), is available from American Cyanamid as Pyroset Tho and also available from Albright & Wilson, Inc., under the name Retardol S, which is a pale, straw-colored liquid that is miscible with water and has a pungent odor.

Flame Resistance Testing Methods—the following testing procedures were used:

FR Federal Test Method 5903 is intended for use in determining the resistance of cloth to flame and glow propagation and tendency to char. A rectangular cloth test specimen (70mm×120mm) with the long dimension parallel to the warp or fill direction is placed in a holder and suspended vertically in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspended in a draft-free area in the same vertical position as in the test cabinet. Char length, the distance (in inches) from the end of the specimen, which was exposed to the flame, to the end of a lengthwise tear through the center of the charred area to the highest peak in the charred area, is also measured. Five specimens from each sample are usually measured and the results averaged.

FR Federal Test Method 5905, flame contact test—a measurement of the resistance of textiles and other materials to flame propagation that exposes the specimen to the flame source for a longer period of time than test method 5903. A test specimen the same size as in the above method is exposed to a high temperature butane gas flame 3 inches in height by vertical suspension in the flame for 12 seconds, the lowest part of the specimen always 1.5 inches above the center of the burner. At the end of 12 seconds, the specimen is withdrawn from the flame slowly, and any afterflaming is timed. Then the specimen is re-introduced into the flame and again slowly withdrawn after 12 seconds and any afterflame timed. For each 12-second exposure the results are reported as: ignites, propagates flame; ignites but is self-extinguishing; is ignition resistant; melts; shrinks away from the flame; or drops flaming pieces.

Limiting Oxygen Index (LOI) is a method of measuring the minimum oxygen concentration needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

EXAMPLE 1

A flame-retardant finish solution containing THPS for the cotton component and a dispersion of hexabromocyclododecane for the polyester was padded onto a yarn dyed 50/50 polyester/cotton blend fabric at approximately a 72% wet pick-up. The padded fabric was cured under different conditions as specified below, oxidized with hydrogen peroxide (30:1 liquid-to-fabric ratio, 1% $H_2O_2$, 160° F. for 2 minutes), and then laundered 50 times.

Curing was at two humidity levels (0.008 lb. water/lb. air and 0.08 lb. water/lb. air), seven temperature levels, and four residence times in a Benz oven; see Table 1. Another humidity level curing test was performed by drying samples at 350° F., with 60 seconds residence time in the Benz oven and subsequently curing at five temperature levels and four residence times in a Werner-Mathis steamer, 100% high-temperature steam; see Table 2.

TABLE 1

Residence Time, Temperature and Humidity - Benz Oven

| Temp °F. | Humidity lb. water/lb air | Residence Time - Seconds 30 | 60 | 90 | 120 |
|---|---|---|---|---|---|
| 300 | 0.08 | — | X | X | X |
| 320 | 0.08 | — | X | X | X |
| 340 | 0.008 | — | X | X | X |
| | 0.08 | — | X | X | X |
| 360 | 0.008 | X | X | X | X |
| | 0.08 | X | X | X | X |
| 380 | 0.008 | X | X | X | X |
| | 0.08 | X | X | X | X |
| 400 | 0.008 | X | — | — | — |
| | 0.08 | X | X | X | X |
| 420 | 0.08 | X | X | X | — |

TABLE 2

Residence Time, Temperature - Werner-Mathis Steamer

| Temp °F. | Residence Time, Minutes 2 | 4 | 6 | 10 |
|---|---|---|---|---|
| 300 | X | X | X | X |
| 320 | X | X | X | X |
| 340 | X | X | X | X |
| 360 | X | X | X | X |
| 380 | X | X | X | X |

Samples were taken as run for bromine analysis (columns headed "I" in Tables 3 and 4); and for bromine and phosphorus analysis after one oxidative wash (1×) and again after 50 normal washes (50×). The results are presented in Tables 3 and 4.

TABLE 3

Phosphorus and Bromine Analyses - Benz Oven

| °F. | H** | | I | 30 Sec.* 1x | 30 Sec.* 50x | I | 60 Secs.* 1x | 60 Secs.* 50x | I | 90 Secs.* 1x | 90 Secs.* 50x | I | 120 Secs.* 1x | 120 Secs.* 50x |
|---|---|---|---|---|---|---|---|---|---|---|---|---|---|---|
| 300 | .08 | % P | — | — | — | — | 0.15 | 0.15 | — | 1.33 | 0.67 | — | 1.71 | 1.74 |
| | | % Br | — | — | — | 2.70 | 1.44 | 0.11 | 2.80 | 2.14 | 0.28 | 2.89 | 2.32 | 0.40 |
| 320 | .08 | % P | — | — | — | — | 0.11 | 0.20 | — | 2.42 | 1.61 | — | 2.71 | 2.12 |
| | | % Br | — | — | — | 2.76 | 1.29 | 0.29 | 2.82 | 2.31 | 0.44 | 2.85 | 2.29 | 0.62 |
| 340 | .008 | % P | — | — | — | — | 2.61 | 1.80 | — | 2.66 | 2.15 | — | 2.68 | 2.29 |
| | | % Br | — | — | — | 2.69 | 2.09 | 0.57 | 2.63 | 2.22 | 0.77 | 2.58 | 2.18 | 0.95 |
| | .08 | % P | — | — | — | — | 2.61 | 0.96 | — | 2.68 | 1.96 | — | 2.68 | 2.26 |
| | | % Br | — | — | — | 2.76 | 2.24 | 0.45 | 2.83 | 2.37 | 0.74 | 2.84 | 2.45 | 0.93 |
| 360 | .008 | % P | — | 0.09 | 0.13 | — | 2.67 | 2.01 | — | 2.63 | 2.29 | — | 2.60 | 2.32 |
| | | % Br | 2.52 | 0.96 | 0.11 | 2.58 | 1.82 | 0.85 | 2.51 | 1.89 | 1.16 | 2.54 | 1.96 | 1.41 |
| | .08 | % P | — | 0.11 | 0.18 | — | 2.64 | 1.87 | — | 2.62 | 2.29 | — | 2.63 | 2.40 |
| | | % Br | 2.60 | 1.02 | 0.11 | 2.83 | 2.11 | 0.77 | 2.71 | 2.38 | 1.08 | 2.70 | 2.22 | 1.35 |
| 380 | .008 | % P | — | 0.13 | 0.10 | — | 2.68 | 2.30 | — | 2.63 | 2.31 | — | 2.57 | 2.24 |

TABLE 3-continued

| | | | Phosphorus and Bromine Analyses - Benz Oven | | | | | | | | | | | |
|---|---|---|---|---|---|---|---|---|---|---|---|---|---|---|
| | | | | 30 Sec.* | | | 60 Secs.* | | | 90 Secs.* | | | 120 Secs.* | |
| °F. | H** | | I | 1x | 50x | I | 1x | 50x | I | 1x | 50x | I | 1x | 50x |
| | | % Br | 2.74 | 2.19 | 0.32 | 2.68 | 2.43 | 1.35 | 2.63 | 2.34 | 1.70 | 2.30 | 1.78 | 1.87 |
| | .08 | % P | — | 2.63 | 2.35 | — | 2.63 | 2.19 | — | 2.47 | 2.60 | — | 2.23 | 2.39 |
| | | % Br | 2.68 | 2.21 | 1.12 | 2.61 | 2.37 | 1.26 | 2.61 | 2.27 | 1.74 | 2.36 | 2.21 | 1.74 |
| 400 | .008 | % P | — | 0.25 | 0.17 | — | — | — | — | — | — | — | — | — |
| | | % Br | 2.78 | 2.11 | 0.84 | — | — | — | — | — | — | — | — | — |
| | .08 | % P | — | 0.11 | 0.26 | — | 2.60 | 2.38 | — | 2.53 | 2.38 | — | 2.59 | 2.16 |
| | | % Br | 2.62 | 1.97 | 0.16 | 2.67 | 2.45 | 1.77 | 2.47 | 2.33 | 2.00 | 2.08 | 2.03 | 1.87 |
| 420 | .08 | % P | — | 0.88 | 0.59 | — | 1.68 | 2.32 | — | 2.02 | 2.06 | — | — | — |
| | | % Br | 2.68 | 2.15 | 0.88 | 2.58 | 2.26 | 1.68 | 2.26 | 2.03 | 2.02 | — | — | — |

*Residence time in oven
**Humidity in oven, lb. water/lb. air

TABLE 4

| | | Phosphorus and Bromine Analyses - Werner-Mathis Steamer | | | | | | | | | | | |
|---|---|---|---|---|---|---|---|---|---|---|---|---|---|
| | | | 2 Min. | | | 4 Min. | | | 6 Min. | | | 10 Min. | |
| | °F. | I | 1x | 50x | I | 1x | 50x | I | 1x | 50x | I | 1x | 50x |
| 300 | % P | — | 2.95 | 2.06 | — | 2.71 | 2.24 | — | 2.61 | 2.26 | — | 2.70 | 2.39 |
| | % Br | 3.58 | 1.87 | 0.59 | 3.94 | 1.93 | 0.62 | 2.74 | 1.78 | 0.72 | 2.67 | 1.95 | 0.81 |
| 320 | % P | — | 2.71 | 2.23 | — | 2.68 | 2.31 | — | 2.71 | 2.39 | — | 2.68 | 2.36 |
| | % Br | 2.73 | 1.96 | 0.74 | 2.67 | 1.96 | 1.00 | 2.68 | 1.83 | 1.12 | 2.56 | 1.82 | 1.17 |
| 340 | % P | — | 2.72 | 2.33 | — | 2.66 | 2.38 | — | 2.57 | 2.35 | — | 2.53 | 2.23 |
| | % Br | 2.71 | 2.14 | 1.12 | 2.71 | 2.11 | 1.35 | 2.65 | 2.09 | 1.47 | 2.48 | 2.08 | 1.89 |
| 360 | % P | — | 2.71 | 2.43 | — | 2.54 | 2.18 | — | 2.49 | 2.13 | — | 2.42 | 1.88 |
| | % Br | 2.71 | 2.25 | 1.56 | 2.55 | 2.30 | 1.92 | 2.41 | 2.24 | 2.19 | 2.20 | 1.94 | 2.24 |
| 380 | % P | — | 2.52 | 2.26 | — | 2.52 | 2.05 | — | 2.39 | 1.85 | — | 2.35 | 1.66 |
| | % Br | 2.58 | 2.27 | 2.02 | 2.38 | 2.11 | 2.39 | 2.12 | 1.93 | 2.35 | 1.86 | 1.61 | 2.05 |

Based on the total phosphorus and bromine content after 50 washes, samples were selected for flammability testing (DOC-FF-3-71). The results of this test on samples washed 50 times are presented in Tables 5 & 6 along with test results from a modified DOC-FF-3-71 test in which some of the samples were tested under ambient conditions.

TABLE 5

| | | Flammability Tests - Benz Oven - Residence Time 90 Seconds | | | |
|---|---|---|---|---|---|
| | | Oven Humidity | | | |
| | | 0.08 lb water lb air Char Length, in. | | 0.008 lb water lb air Char Length, In. | |
| Temp °F. | Condition[1] | Warp | Fill | Warp | Fill |
| 340 | D | 1.9 | 4.9 | — | — |
| | | 6.2 | 5.7 | — | — |
| | N | 1.6 | 2.2 | 5.5 | 7.8 |

TABLE 5-continued

| | | Flammability Tests - Benz Oven - Residence Time 90 Seconds | | | |
|---|---|---|---|---|---|
| | | Oven Humidity | | | |
| | | 0.08 lb water lb air Char Length, in. | | 0.008 lb water lb air Char Length, In. | |
| Temp °F. | Condition[1] | Warp | Fill | Warp | Fill |
| | | 0.9 | 0.2 | 10.0[2] | 7.0 |
| 360 | D | 4.6 | 3.5 | 1.0 | 1.0 |
| | | 1.6 | 0.6 | 1.4 | 1.0 |
| | N | 0.4 | 1.3 | 0.8 | 0.7 |
| | | 1.8 | 1.1 | 1.3 | 0.7 |
| 380 | D | 4.5 | 1.6 | 1.1 | 6.2 |
| | | 5.0 | 1.5 | 4.9 | 1.3 |
| | N | 1.2 | 1.3 | 0.7 | 0.3 |
| | | 1.1 | 1.0 | 0.4 | 0.7 |

[1]D = Standard DOC-FF-3-71
[2]N = Ambient Conditions - 3 second Vertical Burn Test

TABLE 6

| | | Flammability Test 5 - Werner Mathis Steamer | | | | | | | |
|---|---|---|---|---|---|---|---|---|---|
| | | Char Length, Inches Dwell Time in Steamer, Minutes | | | | | | | |
| Dwell Time in Steamer, min. | | 2 Char Length Inches | | 4 Char Length Inches | | 6 Char Length Inches | | 10 Char Length Inches | |
| Temp °F. | Condition* | Warp | Fill | Warp | Fill | Warp | Fill | Warp | Fill |
| 300 | D | — | — | 1.2 | 1.5 | — | — | — | — |
| | | — | — | 1.3 | 4.7 | — | — | — | — |
| 320 | D | — | — | 0.9 | 0.5 | — | — | — | — |
| | | — | — | 1.7 | 0.4 | — | — | — | — |
| | N | — | — | 0.2 | 1.7 | — | — | — | — |
| | | — | — | 1.4 | 1.3 | — | — | — | — |
| 340 | D | — | — | — | — | 1.7 | 1.8 | — | — |
| | | — | — | — | — | 1.7 | 1.8 | — | — |
| 360 | D | — | — | 2.1 | 1.3 | — | — | 1.9 | 1.8 |
| | | — | — | 4.9 | 1.3 | — | — | 1.3 | 10.00** |
| 380 | D | 1.4 | 1.4 | 6.9 | 5.6 | — | — | — | — |

TABLE 6-continued

| Flammability Test 5 - Werner Mathis Steamer | | | | | | | | | |
|---|---|---|---|---|---|---|---|---|---|
| | | Char Length, Inches Dwell Time in Steamer, Minutes | | | | | | | |
| | | 2 Char Length Inches | | 4 Char Length Inches | | 6 Char Length Inches | | 10 Char Length Inches | |
| Dwell Time in Steamer, min. | | | | | | | | | |
| Temp °F. | Condition* | Warp | Fill | Warp | Fill | Warp | Fill | Warp | Fill |
| | | 1.6 | 1.8 | 10.0** | 1.4 | — | — | — | — |

*D = Standard DOC-FF-3-71
**Failed

Fabric time/temperature profiles were made for each sample cured in the Benz oven. Temperatures were measured using a thermocouple pinned to the fabric surface and continuously recorded on a strip chart recorder. The areas under the curves were measured for base lines of 248, 300 and 320° F. using a planimeter, and the data are reported in Table 7.

TABLE 7

| Time/Temperature Effect Humidity = 0.08 Lb Water/Lb Air Area Under Curve, °F. -Sec. | | | | | | |
|---|---|---|---|---|---|---|
| Temp °F. | Time, Sec. | % P | % Br | Above 120° C. (248° F.) | Above 300° F. | Above 320° F. |
| 300 | 60 | 0.15 | 0.11 | 189 | 0 | 0 |
| | 90 | 0.67 | 0.28 | 826 | 0 | 0 |
| | 120 | 1.74 | 0.04 | 2236 | 0 | 0 |
| 320 | 60 | 0.20 | 0.29 | 810 | 0 | 0 |
| | 90 | 1.61 | 0.44 | 1539 | 27 | 0 |
| | 120 | 2.12 | 0.62 | 3283 | 292 | 0 |
| 340 | 60 | 0.96 | 0.45 | 1015 | 27 | 0 |
| | 90 | 1.96 | 0.74 | 2252 | 729 | 405 |
| | 120 | 2.26 | 0.93 | 4282 | 1199 | 362 |
| 360 | 30 | 0.18 | 0.11 | 227 | 0 | 0 |
| | 60 | 1.87 | 0.77 | 1723 | 373 | 103 |
| | 90 | 2.29 | 1.08 | 3321 | 1080 | 486 |
| | 120 | 2.40 | 1.35 | 5341 | 2068 | 1026 |
| 380 | 30 | 2.35 | — | — | — | — |
| | 60 | 2.19 | 1.77 | 2565 | 729 | 326 |
| | 90 | 2.60 | 1.74 | 5746 | 2673 | 1723 |
| | 120 | 2.39 | 1.74 | 9466 | 4855 | 3380 |
| 400 | 30 | 0.26 | 0.16 | 1019 | 189 | 38 |
| | 60 | 2.38 | 1.77 | 3521 | 1436 | 875 |
| | 90 | 2.38 | 2.00 | 6469 | 3310 | 2327 |
| | 120 | 2.16 | 1.87 | 11,167 | 6430 | 4700 |
| 420 | 30 | 0.59 | 0.88 | 913 | 124 | 16 |
| | 60 | 2.32 | 1.68 | 3812 | 1793 | 1242 |
| | 90 | 2.06 | 2.02 | 6421 | 3532 | 2646 |

Curing—Several of the samples cured for low residence times, e.g., 400° F., 30 sec.; 380° F., 30 sec.; 360° F., 30 sec.; and 300° sec., were not dry to the touch, indicating an inadequate cure. This observation was later verified by the bromine and phosphorus analyses in Table 3. The bromine content of the sample cured at 300° F. for 60 sec. was 2.7% initially, but only 0.11% after 50 washes. While the initial phosphorus content was not determined, it was only 0.15% after 50 washes.

Extreme curing conditions, e.g., 400° F. for 120 seconds, gave visual yellowing and harsh hand. Samples processed through the Werner-Mathis steamer yellowed badly at 380° F. for 10 minutes and 360° F. for 10 minutes. The degradation of the cotton portion can be seen in the apparent increase in bromine fixation for 380° F. for 10 minutes in Table 4. The fixation (2.05%) after 50 washes was greater than the initial deposition (1.86%).

Flammability Tests—Samples were selected on the basis of acceptable hand and their % bromine and phosphorus fixation. Of the 12 samples selected, three failed the DOC-FF-3-71 test. The sample cured at 340° F. for 90 secs. at low humidity apparently did not contain sufficient fixed bromine (0.77%—Table 3) to prevent burning. The same apparent fixation (0.74%) for the high humidity sample at the same temperature and time was adequate in another flammability sample (Table 5). The difference may be attributed to better diffusion when water is present.

Other samples (380° F., 4 minutes; 360° F., 10 minutes) selected from the high-temperature steam trials also failed. Table 4 reporting the % bromine in the samples shows a decrease in bromine after one wash but an increase after 50 washes. This can only occur when the cotton is sufficiently degraded by the curing that it washes out of the fabric. These samples lost 9 and 14% of their respective weights between one wash and 50 washes.

On the basis of the data analyzed in this example, it was determined that presence of steam in the curing oven improved the hand of the flame-retardant finishes on the polyester/cotton blend. It is believed that the high humidity in curing minimizes migration of the chemicals on the fabric. It thus permits the use of smaller amounts of chemicals, and reduces the tendency of Antiblaze 19T to smoke at higher temperatures, as well as improving the fabric hand. While the process of this invention may be conducted at ambient humidity at the cure stage, a practical upper limit is 22% absolute humidity, with about 10% absolute humidity (that is, 10 pounds of water per 100 pounds of oven air) is preferred.

EXAMPLE 2

A flame-retardant finish solution containing, by weight, 50% THPS, 15.7% urea and 10% Antiblaze 19T, was padded onto a 65/35 polyester/cotton blend fabric (yarn dyed, 7.0 oz/yd$^2$) at a wet pick-up of 70%. The samples so padded were cured at 360° F. for 90 secs., then oxidized with hydrogen peroxide (30:1 liquid-to-fabric ratio), 1% $H_2O_2$ actual, at 160° F. for 2 minutes (as in Example 1), then scoured.

Samples so prepared were subjected to the Limiting Oxygen Index test and found to have an LOI value of 0.282. The results of the FTM-5903 12-seconds ignition, bottom vertical test method are as follows:

| Warp Direction | | | Filling Direction | | |
|---|---|---|---|---|---|
| Afterflame | Char | Afterglow | Afterflame | Char | Afterglow |
| 0 | 3.9 | 0 | 0 | 4.0 | 0 |
| 0 | 3.8 | 0 | 0 | 4.1 | 0 |
| 0 | 4.0 | 0 | 0 | 4.0 | 0 |
| 0 | 4.1 | 0 | 0 | 4.1 | 0 |
| 0 | 4.2 | 0 | 0 | 4.2 | 0 |
| 0 | 4.0 | 0 | 0 | 4.1 | 0 |

The results of the FTM-5905 test method, in which 12 inch samples were exposed to a 3 inch Fisher burner butane gas flame for 12 seconds, twice, are as follows:

| Warp 1st After-flame | Warp 2nd After-flame | Warp Un-charred Inches | Fill 1st After-flame | Fill 2nd After-flame | Fill Un-charred Inches |
|---|---|---|---|---|---|
| 0 | 0 | 11.0 | 0 | 0 | 11.0 |
| 0 | 0 | 11.6 | 0 | 1 | 11.0 |
| 0 | 0 | 11.5 | 0 | 0 | 10.5 |
| 0 | 4 | 11.6 | 0 | 0 | 11.2 |
| 0 | 1 | 11.5 | 0 | 0 | 11.0 |
| 0 | 1 | 11.4 | 0 | 0 | 11.0 |

The percentage of sample consumed, calculated by measuring the uncharred area [(12—11.2)÷(12)×100] was 6.6%

EXAMPLE 3

Improvement in hand for polyester/cotton fabrics is demonstrated in this example. Antiblaze 19 was included in the pad bath and steam was used in the curing environment.

Samples of 65/35 polyester/cotton fabric (6.0 oz-/yd$^2$) were finished with the following formulations, one with, the other without Antiblaze 19:

| | Formula I | Formula II |
|---|---|---|
| THPS | 50.0% | 50.0% |
| Urea | 15.7% | 15.7% |
| $NaHPO_4$ | 2.0% | 2.0% |
| polyethylene glycol softener | 3.0% | 3.0% |
| Antiblaze 19 | — | 10.0% |

Fabric samples were padded with the above formulas and cured in a Benz oven; wet pick-up was about 60%. Those samples finished with Formula II were cured in an environment of 10% absolute humidity; samples treated with Formula I were cured in an environment of only 1% absolute humidity.

The resulting products were examined and subjectively evaluated for hand. Samples finished with Formula I were significantly more stiff than those finished with Formula II. After oxidation and even following machine laundering the hand continued to be significantly better for the samples finished with Formula II.

EXAMPLE 4

A production lot of 50/50 polyester/cotton 5.5 oz-/yd$^2$ fabric was finished with the following formulation:

| Chemical | Concentration (%) |
|---|---|
| Water | 16.0 |
| THPS | 55.0 |
| Urea | 14.25 |
| $Na_2HPO_4$ | 2.0 |
| Cyclic phosphonate (Antiblaze 19T) | 8.0 |
| Silicone Softeners | 3.75 |
| Wetting Agent | 1.0 |

The fabric was padded to a wet pickup of 88.2% and cure in a tenter with an abolute humidity of approximately 10%. The resulting substrate was oxidized with hydrogen peroxide and vigorously washed to remove surface chemicals and to soften the hand. The resultant product was compressively shrunk and dried to soften the hand and to control the shrinkage.

Physical test results are reported below. Fabric samples were home laundered at 120° F. up to 100 times to demonstrate the durability of the treatment. Vertical flame test results (FTM-191-5903), phosphorus concentrations, and LOI values (ASTM-D-2863) have been included for fabric in its unlaundered state, and after laundering 50 and 100 times to provide evidence for the efficacy of the treatment.

| Physical Test Results | | | | | |
|---|---|---|---|---|---|
| Shrinkage (% at 120° F.) | | | | Random Tumble Pilling (Grade) | |
| Warp | | Fill | | | |
| 1x | 5x | 1x | 5x | 30 min. | 60 min. |
| −0.67 | −1.40 | −0.23 | −0.60 | 4.0 | 3.5 |

| Wash & Wear Appearance |
|---|
| 3.5 |

| Original Tensile Strength (lbs) | | Original Tear Strength (lbs) | |
|---|---|---|---|
| Warp | Fill | Warp | Fill |
| 112 | 52 | 5.2 | 3.1 |

| Flame Resistance as a Function of Number of Home Launderings | Original | 50x | 100x |
|---|---|---|---|
| Char Length* (in.) | | | |
| Warp | 3.6 | 3.7 | 4.0 |
| Fill | 2.9 | 3.3 | 3.4 |
| After Glow* (sec.) | | | |
| Warp | 0.0 | 0.0 | 0.0 |
| Fill | 0.0 | 0.0 | 0.0 |
| After Burn* (sec) | | | |
| Warp | 0.0 | 0.0 | 0.0 |
| Fill | 0.0 | 0.0 | 0.0 |
| % Phosphorus | 3.42 | 3.14 | 2.77 |
| LOI | 0.281 | 0.281 | 0.261 |

*FTM 191-5903

What is claimed:

1. A process of imparting flame-resistant properties to a polyester/cotton blend fabric comprising the steps of:

(1) applying to a polyester/cotton blend fabric, at least 35% by weight of which is polyester, balance cotton, a flame retarding amount of a cyclic phosphonate ester flame retardant represented by the formula:

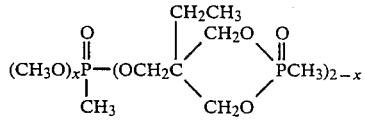

in which x is 0 or 1, that fixes onto polyester fibers, and a flame-retarding amount of a tetrakis-(hydroxymethyl) phosphonium salt flame retardant that fixes onto the cotton fibers, the flame retardant chemicals applied to the fabric simultaneously; and (2) curing the fabric at elevated temperatures to fix the flame retardants to the polyester and to the cotton.

2. The process of claim 1, in which the flame retardants are applied to the fabric at least twice prior to the curing step.

3. The process of claim 1, in which a greige fabric is flame retarded prior to dyeing.

4. The process of claim 1, in which the curing is conducted in the presence of up to about 22% absolute humidity.

5. The process of claim 4, in which the curing is conducted in the presence of about 10% absolute humidity.

6. The process of claim 4, in which the curing is conducted at a temperature in the range of about 300° F. to about 420° F.

7. The process of claim 1, in which the phosphorus-containing flame retardant specific for the cotton component is tetrakis-(hydroxymethyl) phosphonium sulfate.

8. A polyester/cotton blend flame-retardant-treated fabric produced by the process of claim 1.

9. A process of imparting flame-resistant properties to a polyester/cotton blend fabric comprising the sequential steps of:

(1) applying to a polyester/cotton blend fabric, at least 35% by weight of which is polyester, balance cotton, a flame-retarding amount of a cyclic phosphonate ester fire retardant represented by the formula:

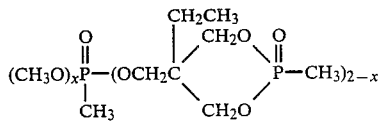

in which x is 0 or 1 that fixes onto polyester fibers;

(2) curing the fabric at elevated temperatures to fix the cyclic phosphonate ester fire retardant to the polyester fibers;

(3) applying to the treated polyester/cotton blend fabric a flame retarding amount of a tetrakis-(hydroxymethyl) phosphonium salt flame retardant that fixes onto the cotton fibers; and (4) curing the fabric at elevated temperatures to fix the phosphorus-containing flame retardant to the cotton fibers.

10. A process of imparting flame-resistant properties to a polyester/cotton blend fabric comprising the steps of:

(1) applying to a polyester/cotton blend fabric, at least 35% by weight of which is polyester, balance cotton, a flame-retarding amount of hexabromocyclododecane that fixes onto polyester fibers, and a flame retarding amount of a tetrakis-(hydroxymethy) phosphonium salt flame retardant that fixes onto cotton fibers, the flame retardants applied to the fabric separately or simultaneously; and (2) curing the fabric at elevated temperatures to fix the flame retardants to the polyester and to the cotton fibers.

11. The process of claim 10, in which the flame retardants are applied to the polyester/cotton blend fabric simultaneously.

12. The process of claim 11, in which the flame retardants are applied to the fabric at least twice prior to the curing step.

13. The process of claim 10, in which the greige fabric is flame retarded prior to dyeing.

14. The process of claim 10, in which the curing is conducted in the presence of about 22% absolute humidity.

15. The process of claim 14, in which the curing is conducted in the presence of about 10% absolute humidity.

16. The process of claim 14, in which the curing is conducted at a temperature in the range of about 300° F. to about 420° F.

17. The process of claim 10, in which the phosphorus-containing flame retardant specific for the cotton component is tetrakis-(hydroxymethyl) phosphonium sulfate.

18. A process of imparting flame-retardant properties to a polyester/cotton blend fabric comprising the sequential steps of:

(1) applying to a polyester/cotton blend fabric, at least 35% by weight of which is polyester, balance cotton, a fire retarding amount of a cyclic phosphonate ester fire retardant represented by the formula;

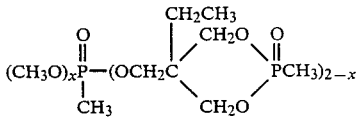

in which x is 0 or 1 that fixes onto polyester fibers.

(2) curing the fabric at elevated temperatures in the presence of up to 22% absolute humidity to fix the cyclic phosphonate ester fire retardant to the polyester fibers;

(3) applying to the treated polyester/cotton blend fabric a flame-retarding amount of a tetrakis-(hydroxymethyl) phosphonium salt flame retardant that fixes onto the cotton fibers; and (4) curing the fabric at elevated temperatures in the presence of up to 22% absolute himidity to fix the phosphorus-containing flame retardant to the cotton fibers.

19. The process of claim 18, in which curing step (b) is conducted in the presence of about 10% absolute humidity.

20. A polyester/cotton blend flame-retardant-treated fabric produced by the process of claim 9.

21. A polyester/cotton blend flame-retardant-treated fabric produced by the process of claim 10.

22. A polyester/cotton blend flame-retardant-treated fabric produced by the process of claim 18.

23. A flame resistant polyester/cotton fabric containing from 35% to 80% by weight polyester, balance cotton, having a cyclic phosphonate ester flame retardant represented by the formula:

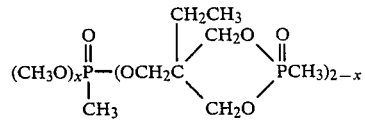

in which x is 0 or 1 fixed onto the polyester fibers and a tetrakis-(hydroxymethyl) phosphonium salt flame retardant fixed onto the cotton fibers, the fabric having a Limiting Oxygen Index of at least 27% after 50 launderings.

* * * * *